US005457901A

United States Patent [19]

Gernstein et al.

[11] Patent Number: 5,457,901

[45] Date of Patent: Oct. 17, 1995

[54] RECOIL ABSORPTION MEANS FOR A SHOTGUN

[76] Inventors: Terry M. Gernstein, 1015 Salt Meadow La., McLean, Va. 22101; William Scarpino, 8101 NW. 46th Ct., Lauderhill, Fla. 33351

[21] Appl. No.: 180,325

[22] Filed: Jan. 12, 1994

[51] Int. Cl.[6] ..... F41A 5/24

[52] U.S. Cl. ..... 42/1.06; 89/198

[58] Field of Search ..... 42/1.06; 89/1.4, 89/198, 199

[56] References Cited

U.S. PATENT DOCUMENTS

| | | | |
|---|---|---|---|
| 784,966 | 3/1905 | Smith | 89/198 |
| 1,356,191 | 10/1920 | Craig | 89/198 |
| 2,108,026 | 2/1938 | Sutter et al. | 89/198 |
| 4,492,050 | 1/1985 | Kagehiro | 42/1.06 |
| 4,867,039 | 9/1989 | Dobbins | 89/127 |
| 4,938,116 | 7/1990 | Royster | 89/198 |
| 5,164,534 | 12/1992 | Royster | 89/198 |

FOREIGN PATENT DOCUMENTS

| | | | |
|---|---|---|---|
| 1038449 | 9/1958 | Germany | 89/199 |

OTHER PUBLICATIONS

Nonte, George C. Jr., Firearms Encyclopedia, "Pump Action Rifle", 1973, p. 200.

*Primary Examiner*—Stephen C. Bentley

*Attorney, Agent, or Firm*—Terry M. Gernstein

[57] ABSTRACT

A shotgun, such as a pump shotgun, has the recoil thereof controlled a spring system. The shotgun includes a breech bolt that is locked to an operating arm during cocking, but is then released from that operating arm when in the battery location and is held in the battery position by the spring system. The spring system includes springs that are engaged with an element that moves in response to the firing of the shotgun, and are sequentially released from that moving element as that element recoils. One form of the invention includes a pump shotgun in which the breech block moves in a recoil movement in response to firing the shotgun, with the springs engaging the moving breech block and sequentially disengaging from that moving breech block. The breech block is releasably attached to the cocking rails of the pump shotgun by one-way locks so the block can be moved back into a breech covering location by the normal action associated with cocking a pump shotgun, but will be released to move in a recoil movement upon firing the shotgun. Another form of the invention releases a weight to contact the shotgun in a forward direction when recoil energy in the barrel is at or near its maximum to counter that recoil energy.

20 Claims, 7 Drawing Sheets

FIG. 5
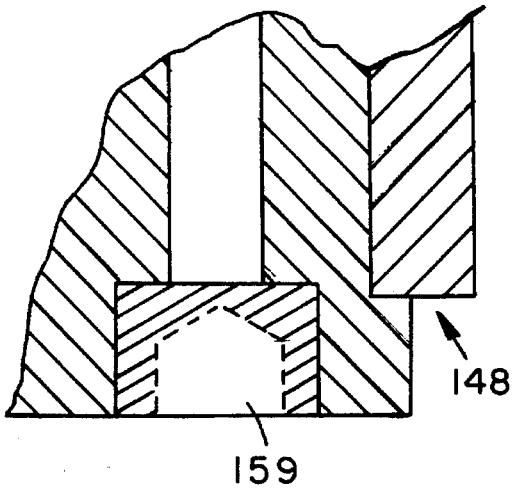
FIG. 7
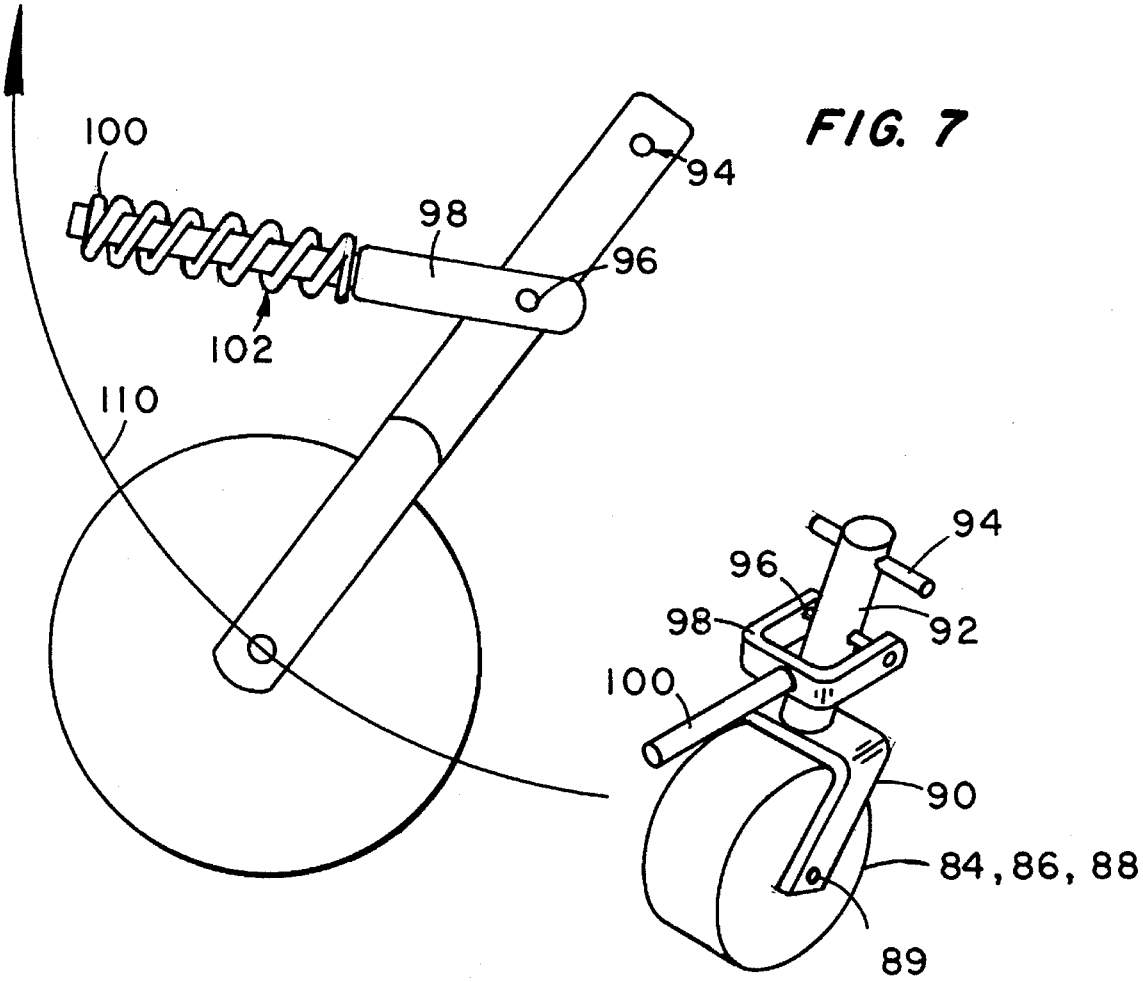
FIG. 6

RECOIL ABSORPTION MEANS FOR A SHOTGUN

TECHNICAL FIELD OF THE INVENTION

The present invention relates to the general art of hand-held weapons, and to the particular field of shotguns.

BACKGROUND OF THE INVENTION

Sport shooting, especially shooting with a shotgun, has become increasingly popular. Such sport shooting includes target shooting as well as trap shooting in addition to hunting. As the popularity of this sport increases, more women, novices and children are becoming interested in the sport. Additionally, competition events are becoming even more popular.

While such sport shooting is generally safe under proper conditions, there are some drawbacks to the firing of a shotgun. These drawbacks may be exacerbated when the person firing the weapon is a novice, a child, or someone of slight stature who is not used to firing a weapon such as a shotgun that has a recoil. This recoil can range from slight to very heavy depending on shot size, and can be a problem if the weapon is fired repeatedly and for long periods of time, such as might occur during a competition. Such recoil may discourage some people from the sport.

Therefore, there is a need for a recoil absorption system that effectively and efficiently absorbs recoil of a weapon such as a shotgun.

The art includes many inventions that are intended to reduce the recoil felt by the shooter. An example of such an invention is disclosed in U.S. Pat. No. 4,492,050. However, inventions, such as the just-mentioned patented invention, require a gas system to reduce this recoil. Gas systems require ports and conduits, which may become clogged due to the residue associated with the powder used in ammunition fired by shotguns. Once the ports or conduits of the gas system become clogged, the efficiency of the recoil system is inhibited if not totally vitiated. The art also contains some examples of recoil control systems that include cushions and the like. These systems do not absorb recoil, they merely alter the time the recoil is felt by the shooter. While this delaying process can be effective in some instances, it is not completely effective in all situations for all shooters.

Therefore, there is a need for a system that can be used on a shotgun that absorbs recoil, but will not be adversely affected by the products associated with the normal firing of the ammunition fired by the shotgun.

Still further, operation of weapons, such as a shotgun, causes the barrel of the weapon to rise. While most shooters learn to compensate for barrel rise, some shooters never learn to effectively and completely compensate for barrel rise. In fact, the outcome of some competitions may even be affected by how well the competitors continue to compensate for barrel rise as the competition enters its final phases. This compensation can be affected by recoil as well if the shooter becomes tired and the recoil wears on him or her. Recoil and barrel rise are even more critical if rapid firing is required. All of the above-mentioned factors are made even more important if the shooter is young, a novice or the like.

Therefore, there is a need for a recoil absorption system that can be used on a shotgun which also reduces barrel rise associated with the firing of the weapon.

Due to the increasing popularity of shooting, many people are using shotguns for several different purposes. For example, a shotgun originally purchased for hunting is often used in competitions, or in trap shooting. It is simply too expensive for many people to purchase several different shotguns. From the foregoing discussion of recoil and barrel rise, it can be understood that there are different constraints placed on weapons used for hunting and weapons used for competition shooting. Therefore, to be most effective, a user should purchase a competition weapon if he or she already owns a hunting weapon or vice versa. This can be expensive.

Therefore, there is a need for a recoil absorption system that can be retrofit onto an existing weapon to make that weapon effective as both a hunting weapon and a competition weapon.

Still further, if a weapon is used by more than one person, and one person is more sensitive to recoil than the other, the weapon should be set up to satisfy the needs of the more sensitive user. Therefore, in some instances, more than one weapon is required if a second shooter takes up the sport. This also is expensive.

Therefore, there is a need for a recoil absorption system that can be retrofit onto an existing weapon to make that weapon useable by a shooter who is sensitive to recoil.

OBJECTS OF THE INVENTION

It is a main object of the present invention to provide a recoil absorption system for use on a shotgun which absorbs significant amounts of recoil energy.

It is another object of the present invention to provide a recoil absorption system for use on a shotgun which reduces barrel rise.

It is another object of the present invention to provide a recoil absorption system for use on a shotgun which is not as susceptible to inhibited performance or reduced operation due to exposure to powder products associated with firing shotgun operation as gas operated recoil absorption systems.

It is another object of the present invention to provide a recoil absorption system for use on a shotgun which can be used on a pump-type shotgun.

It is another object of the present invention to provide a recoil absorption system for use on a shotgun which can be retrofit onto an existing shotgun.

SUMMARY OF THE INVENTION

These, and other, objects are achieved by a spring system for absorbing recoil energy associated with firing a shotgun. The spring system is connected to a portion of the shotgun that moves in response to the firing process, and recoil energy is transferred to the spring system to be absorbed thereby.

One form of the recoil absorption system is used on a pump-type shotgun. In this form, the breech bolt is cocked in the manner of the usual pump shotgun. However, the breech block is permitted to move in response to the firing of the weapon instead of remaining stationary as is the case with prior art pump shotguns. While it is recognized that the term "pump shotgun" refers, in the prior art, to a shotgun having a locked breech block and a cycle that is carried out manually, as used herein, to indicate that the shotgun embodying the present invention is operated by manually moving the breech block into a battery position, but is free to move away from the battery position under the influence of the gases generated by the firing of a round of ammunition after firing the round of ammunition and during a recoil movement the breech block moves away from the battery position, the shotgun embodying the present invention will be referred to as a "pump-type" shotgun rather than a "pump shotgun." The movement of the breech block is controlled by the spring system of the present invention. Recocking the weapon is accomplished using the pump elements of the shotgun. The spring system is mounted either on the barrel, on the receiver or on the breech block itself, and includes rollers that move over roller-engaging surfaces that move relative to the rollers. The rollers move off of the roller-engaging surfaces after a pre-determined time to disengage the spring system. The rollers are re-engaged against the roller-engaging surfaces during the cocking process. One form of the invention includes a plurality of rollers which sequentially disengage from the breech block as the breech block traverses the recoil path. The pump-type shotgun also includes a system of latches which engage the pump breech block operating rails to lock the breech block to those elements for cocking, but which disengage from the pump elements after cocking to disengage the block after cocking to permit the breech block to move under the control of the spring system after the weapon is fired.

The spring system is mounted on the barrel or on an extension of the barrel when the receiver section of the shotgun is made of light material, such as aluminum, but can be mounted on the receiver when the receiver is made of strong materials, such as steel.

Another form of the recoil absorption system includes a weight element slidably mounted on a magazine tube of the weapon. The weight element is located at one end of that tube at initiation of the firing sequence. The weight is held in place by a lock and is spring biased toward the other end of that tube to move toward that other end when the lock is disengaged. The lock is disengaged in timed sequence so the weight slides on the magazine tube and reaches that other end when pressure in the barrel is at or near the maximum. The recoil of the weapon created by this barrel pressure is thus neutralized by the inertial energy associated with the weight. This form of the recoil absorption system can be used while maintaining the locked nature of the breech block whereby the breech block is not permitted to move after the weapon is fired. In this manner, the spring recoil absorption system can be incorporated into a pump action shotgun without requiring modification of breech block action.

Using the spring-controlled recoil absorption system of the present invention eliminates the need for gas ports, gas conduits or other such elements required by gas recoil absorption systems. This spring-controlled system of the present invention also absorbs recoil energy into the springs and effectively controls barrel rise. By selecting spring and spring combinations, a great deal of the recoil energy can be effectively absorbed.

While the recoil absorption system of the present invention can be installed in a new weapon, it can also be retrofit onto existing weapons thereby permitting such existing weapons to be modified for the more effective absorption of recoil energy.

BRIEF DESCRIPTION OF THE DRAWING FIGURES

FIG. 5 is a partial elevational view showing a means for attaching a buffer plate to a shotgun and is an enlarged detail of detail 5 shown in FIG. 2.

FIG. 6 is a perspective view of a roller used to control recoil movement of a breech block in a shotgun.

FIG. 7 is a side elevational view of a roller.

DETAILED DESCRIPTION OF THE PREFERRED EMBODIMENT OF THE INVENTION

Figure 1:
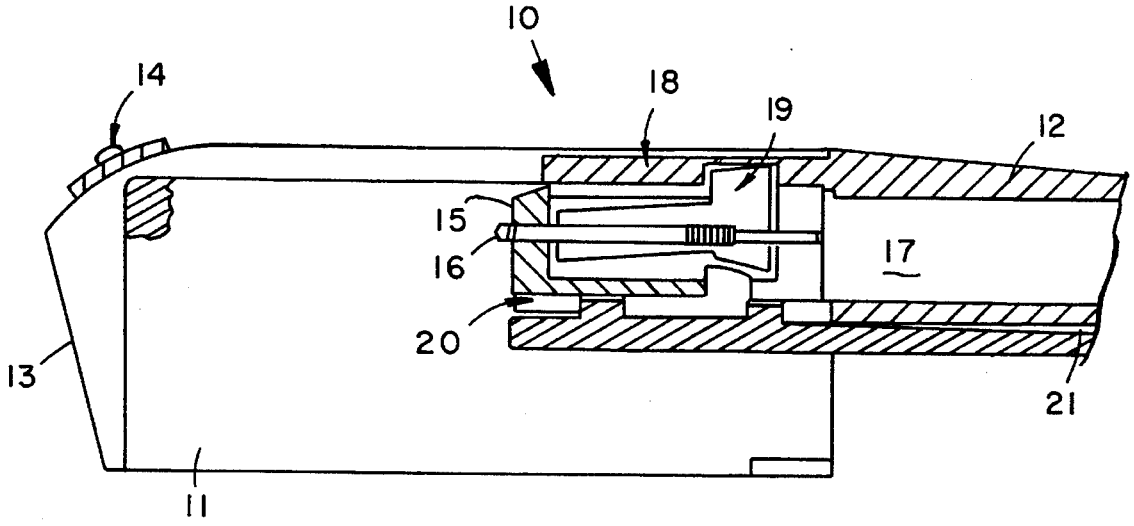
FIG. 1 shows a partially cutaway view of a prior art pump shotgun.

Shown in FIG. 1 is prior art pump shotgun 10 which includes a receiver section 11 connected at one end thereof to a barrel 12 and at the other end thereof to a stock 13. Receiver section 11 is made of aluminum, and has a safety 14 thereon. A breech bolt 15 includes a firing pin 16 that is contacted by a hammer (not shown) to fire a round located in a firing chamber 17. Bolt 15 is locked to barrel hood 18 by a bolt lock 19 which is activated by a lock lifter 20 when operating arms 21 are pulled forward by a pump handle (not shown). Bolt 15 is shown in the battery position. A cartridge will be located in chamber 17 and fired when the trigger of the weapon is activated. When the cartridge is fired, nothing moves, and the bolt remains stationary in the battery location shown in FIG. 1. When the pump handle is pulled rearward, the bolt lock lifter moves rearward lower the bolt lock from the barrel hood. The bolt is moved rearward to eject a spent cartridge. When the pump lever is pushed forward, a new cartridge is lifted and chambered, and the bolt lock is lifted and locked to the barrel hood by the bolt lock lifter. The cycle is carried out manually, and the bolt remains in the battery position unless moved manually by the operating arms under influence of the pump.

In contrast to this, a shotgun incorporating the preferred embodiment of the present invention permits the breech bolt to move in a recoil movement after the cartridge is fired, and this recoil movement is controlled and influenced by at least one, and preferably a plurality of, spring-controlled rollers that sequentially engage ramps and lands as the bolt moves along its recoil path. The bolt is then again locked to the operating arms and is moved manually back to the battery location while remaining locked to the operating arms. Once the bolt reaches the battery location, it is then released from the operating arms and is held in the battery location by at least one of the spring-controlled rollers.

Figure 2:
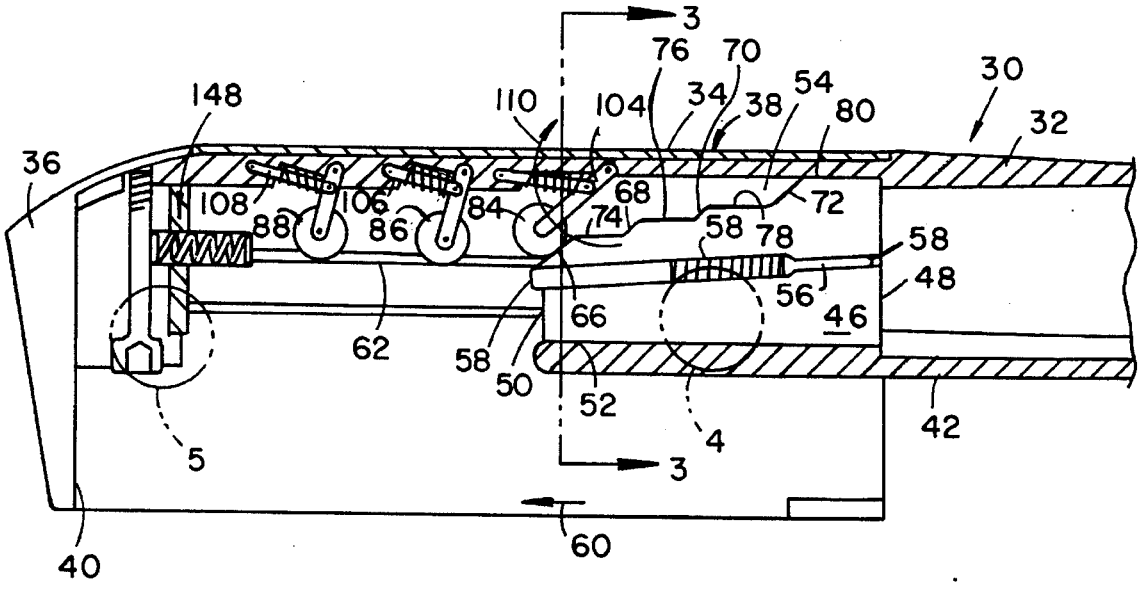
FIG. 2 shows a partially cutaway view of a pump shotgun containing a first form of the spring system of the present invention.

Shown in FIG. 2 is a pump shotgun 30 that has been modified to permit incorporation of the recoil control system of the present invention. Shotgun 30 has a barrel 32 attached to a receiver 34 that is made of aluminum, or other lightweight material, and which has a stock 36 is attached to rear surface 36 of the receiver. Since aluminum is lightweight, barrel 32 is extended as shown by hood 38 from the forward end of receiver 34 towards the stock. The hood extends from the front of the receiver to a location closely adjacent to receiver rear wall inside surface 40 and is formed of material that can be identical to the material of the barrel, that is, strong material such as steel or the like. The need for such strength will be understood from the following discussion. Shotgun 30 also includes operating arms, such as operating arm 42 that are operated in the known manner using a forearm or the like to cock the weapon, eject a spent cartridge, and load a new cartridge from a magazine tube. The operating arms have been slightly modified as will be discussed below.

Figure 3:
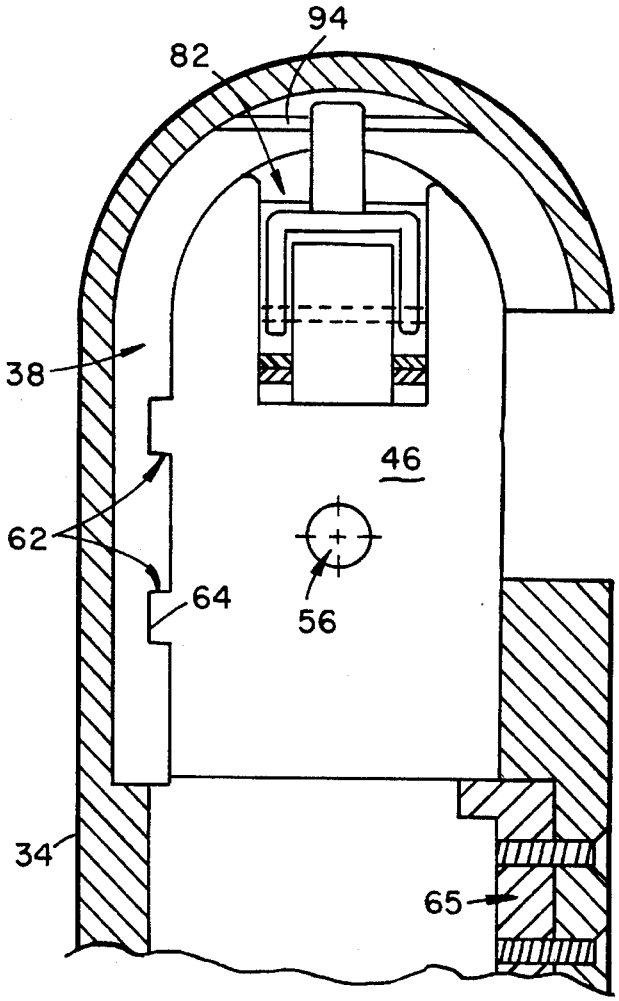
FIG. 3 is an elevational view taken along line 3—3 of FIG. 2.

As shown in FIGS. 2 and 3, shotgun 30 includes a breech block, or bolt 46 having a forward end 48, a rear end 50, a bottom surface 52 and a top surface 54. Bolt 46 is formed of heavy material common to breech bolts and, in the battery position shown in FIG. 2, closes the chamber for firing a round of ammunition when a hammer of the shotgun strikes firing pin 56. As shown, firing pin 56 is oriented at an angle in bolt 46 and includes a rounded rear end 58 whereby the weapon hammer will strike the pin in proper manner to fire a cartridge in the chamber. Firing pin 56 includes a return spring 58 and a forward end 59. The firing pin is located as shown in FIG. 2 so the remainder of the bolt can be modified as will be understood from the present disclosure.

Bolt 46 moves in a recoil direction 60 after shotgun 30 has been fired. Accordingly, hood 38 includes guide grooves 62 defined longitudinally therein, and bolt 46 includes guide rails 64 which slide in grooves 62 to guide the bolt during its recoil movement as well as during its cocking movement in a direction opposite to recoil movement direction 60. There are two guide grooves and two guide rails to ensure proper control of the bolt during all operations herein discussed. Bolt 46 is further guided by a steel rail 65 mounted on receiver 34 beneath bolt 46 and extending from adjacent to the forwardmost end of the receiver adjacent to the rear of barrel 32 to closely adjacent to stock 36. The guide grooves and rail 65 combine to ensure proper movement of bolt 46 during recoil and cocking.

As shown in FIGS. 2 and 3, bolt 46 includes a plurality of ramps 66, 68, 70 and 72 connecting a plurality of landings 74, 76 and 78 and a topmost portion 80 of the bolt. Ramp 66 connects rear end 50 of the bolt to the first landing 74, and begins closely adjacent to the bore in which firing pin 56 is located. with all ramps tapering upwardly toward bolt top surface 54, and all landings being progressively located closer to the topmost portion 80. Topmost portion 80 is located closely adjacent to the top of hood 38. As is best shown in FIG. 3, the ramps and landings are located in a groove 82 defined in bolt 46.

As is also shown in FIGS. 2 and 3, a series of spring-biased rollers 84, 86 and 88 are pivotally mounted on hood 38 to extend into groove 82. The rollers sequentially engage the ramps and landings as the bolt moves from the battery position shown in FIG. 2 to a rearmost recoil position (indicated in FIG. 8). Each roller resists further recoil movement, with roller 84 engaging ramp 66 to hold bolt 46 in its battery position shown in FIG. 2 for firing the weapon.

As is shown in FIGS. 2, 6 and 7, each roller is mounted on an axle 89 that is attached at each of its ends to a yoke 90 that is attached to one end of an arm 92. A pivot pin 94 extends through the other end of arm 92 and is mounted at its ends to hood 38 above groove 82 to extend transversely thereacross. Pivot pin 94 acts as a fulcrum for arm 92. Also attached to arm 92 is a pin 96 that is attached at each of its ends to a yoke 98. Yoke 98 is attached to one end of a yoke arm 100 which is pivotally mounted to hood 38 at its opposite end. A spring 102 surrounds each yoke arm and bears against both the yoke 98 and against the hood to control movement of the roller via the yokes and arms.

The hood includes slots 104, 106 and 108 adjacent to each yoke arm whereby the corresponding yoke arm can swing into the slot as the roller moves over the corresponding ramp along an arc such as shown at 110 in FIG. 7.

Operation of the rollers is best understood with reference to FIG. 2. Roller 84 engages ramp 66 and holds the bolt in the FIG. 2 position covering the chamber until the weapon is fired, and initially on firing of the weapon. As the pressure in the chamber increases after the round is fired, bolt 46 begins to recoil in direction 60. As the bolt moves from the FIG. 2 position in a recoil movement in direction 60, spring 102 on yoke arm 100 associated with roller 84 resists rearward movement of the roller as shown in FIG. 2 by arc 110. This resistance controls the recoil movement of bolt 46, and continues as long as roller 84 is engaged with ramp 66. As bolt 46 continues its recoil movement, the roller 84 moves off of the ramp 66 and onto land 74. Land 74 is parallel to direction 60 and thus roller 84 no longer strongly influences the recoil movement of the bolt. This continues until roller 84 engages ramp 68, at which time roller 86 also engages ramp 66. Now further recoil movement of the bolt is influenced by the springs on both rollers 84 and 86. Further recoil movement of bolt 46 is influences by these rollers until the bolt reaches a location with respect to these rollers at which they move onto lands 76 and 74 respectively. The land 76 is also parallel to direction 60. Therefore, at this time during the recoil movement of the block, both rollers 84 and 86 are on lands and do not significantly influence recoil motion of the bolt. At or about this time, roller 88 contacts ramp 66. The ramps and rollers are positioned with respect to each other so as roller 88 contacts ramp 66, roller 86 contacts ramp 68 and roller 84 contacts ramp 72. At this time, further recoil movement of the bolt is influenced by three springs 102. Such springs can have identical spring characteristics, or the springs associated with rollers 84, 86 and 88 can become stronger respectively. The springs can be progressive springs as well. In this manner, recoil movement of the bolt is resisted more strongly as the bolt moves through its recoil path. Of course, the opposite relationship of spring characteristics can be selected if suitable. The characteristics and locations of the springs, as well as the locations and sizes of the ramps, lands and grooves can all be adjusted to exert any desired degree of control over the recoil movement of bolt 46.

Figure 4:
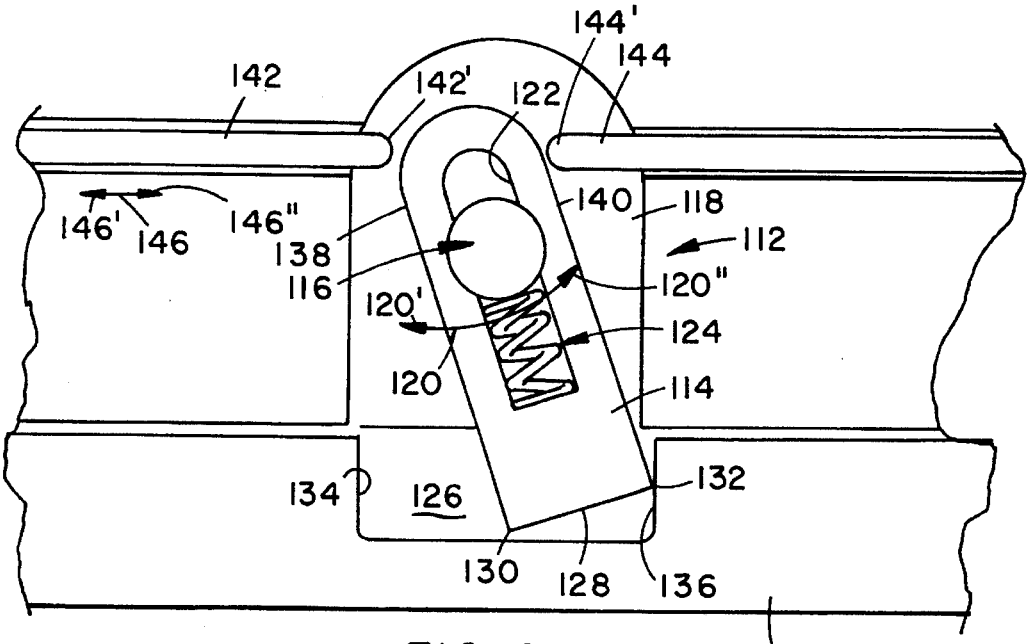
FIG. 4 is an elevational view of a one-way detent system for holding a breech block to an operating arm of a pump shotgun and is an enlarged detail of detail 4 shown in FIG. 2.

Since bolt 46 is permitted to move, shotgun 30 includes means for moving that bolt back into the FIG. 2 position using the normal pumping operation associated with a pump shotgun. Referring first to FIG. 4, a one-way latch mechanism 112 is shown mounted on bolt 46. The preferred form of shotgun 30 includes a latch mechanism on each side of bolt 46, and both latch mechanisms are identical. Therefore, only one latch mechanism will be described. Latch mechanism 112 connects bolt 46 to operating arm 42 after cocking of the weapon to move the bolt from its recoil location adjacent to the rear of the receiver back to the FIG. 2 battery position when the pump operating arm is operated in the manner normal to pump shotguns. However, latch mechanism 112 releases the bolt from the operating arm as soon as the bolt reaches the FIG. 2 battery location whereby bolt recoil movement will be permitted and influenced and controlled by the aforediscussed spring systems.

Latch mechanism 112 includes a pawl 114 pivotally mounted on the side of bolt 46 by a pivot pin 116 in an undercut region 118. Pawl 114 swings on an arc indicated by a double-headed arrow 120, with direction 120' being a direction of locking the bolt to operating arm 42 to move the bolt from its recoil location back to a cocked location, and direction 120" being a direction of freeing bolt from operating arm 42 to permit the bolt to recoil towards the rear of the weapon. Pivot pin 116 is located in an elongated slot 122 defined in pawl 114, and is urged downwards by a spring 124. A groove 126 is defined in operating arm 42 to receive lower edge 128 of pawl 114 with corners 130 and 132 of the arm engaging sides 134 and 136 respectively of the groove for the purposes that will be understood from the following discussion. Swinging movement of pawl 114 is caused by contact between sides 138 and 140 with rods 142 and 144 respectively. The rods are slidably mounted on the bolt to move in directions 146 as the bolt reaches its FIG. 2 position (direction 146') and its recoil location (direction 146"), and engage the pawl 114 as bolt 46 moves in receiver 34. The rods cause the pawl to tip so edge 132 contacts side 136 when operating arm 42 is in the position shown in FIG. 4 when the bolt is in the FIG. 2 battery position. This frees the bolt from the operating arm. However, upon reaching the rearmost recoil location, rod 142 strikes the rear of the receiver chamber, and moves in direction 146". This rod then contacts pawl 114 and swings it in direction 120' so edge 132 is swung beneath edge 130 (opposite to the orientation shown in FIG. 4). In this orientation, when the operating arm is moved rearwardly in a cocking sequence, the pawl will fall into groove 126 with edge 130 jammed against side 134 of groove 126. Now, when operating arm 42 is moved forward (opposite to recoil direction 60), the pawl connects the bolt to that operating arm to move the bolt forward with the operating arm. Upon reaching the battery position shown in FIG. 2, rod 144 contacts the rear end of the barrel and slides in direction 60 to contact pawl 114. This contact moves pawl 114 in direction 120" back into the FIG. 4 orientation with edge 132 engaging side 136. The bolt is now disengaged from the operating arm. The spring 124 ensures that the pawl will remain in a proper orientation to effect the just-described connections and disconnections. Sliding movements of the rods can be effected by the aforediscussed contacts, and also by contact between edges 142' and 144' with the pawl.

Figure 8:
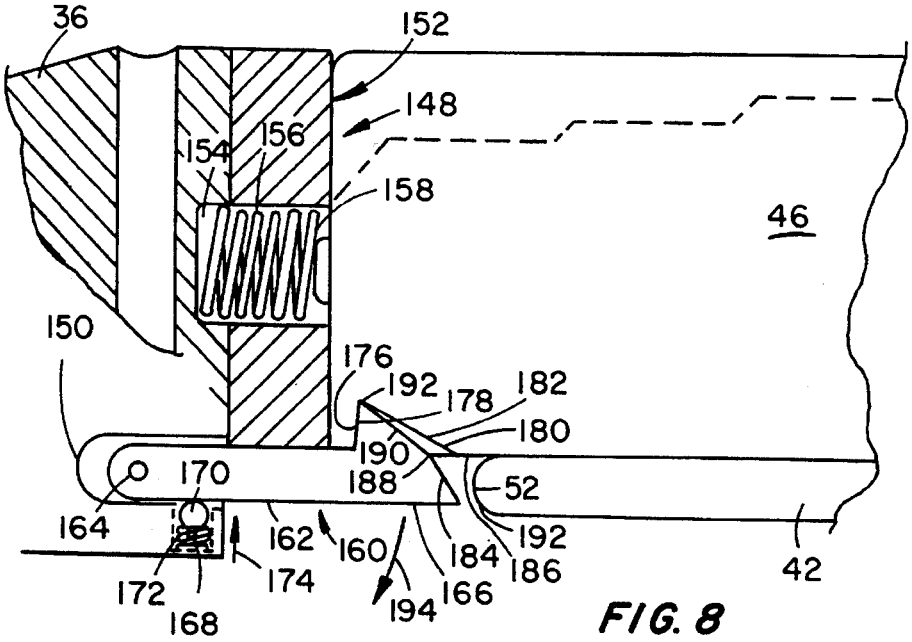
FIG. 8 is a detail view showing a lock for releasably holding a breech block in position against a recoil plate.

In order to ensure that the bolt is in the proper location to be re-engaged with the operating arms after a recoil movement, shotgun 30 includes a terminal buffer 148, best shown in FIGS. 2, 5 and 8. Terminal buffer 148 includes a recoil plate 150 fixed to the shotgun in front of the stock, and a pad, such as a neoprene pad 152 fixed to the plate 150 to be contacted by bolt 46 when that bolt is in the recoil location shown in FIG. 8. Plate 150 of terminal buffer 148 is mounted in the receiver in slots defined on both sides of the receiver, and the plate and pad further include bores 154 and 156 in which a spring 158 is mounted to engage the bolt 46 when that bolt is in the recoil location. Buffer plate 150 is also fixed to the receiver by means of a screw 159 fixing the plate to the hood as shown in FIG. 5. Spring 158 further controls the recoil of the bolt. The bolt is captured so it will remain in the proper position for pawl 114 to engage the proper side of groove 126 in operating arm 42 as above discussed. Terminal buffer 148 therefore includes a bolt capture mechanism 160, shown in FIG. 8. Mechanism 160 includes a lever 162 pivotally mounted on plate 50 by a pivot pin 164 at a proximal end of that lever, with a hook 166 on the distal end of that lever. A plunger 168 has a ball 170 on a top end thereof, and has a spring 172 biasing that ball upwardly in direction 174 and against lever 162 to bias that lever in direction 174. Hook 166 includes a rear surface 176 that engages a corresponding surface 178 on bolt 46 that is defined in an angled groove 180 defined in the bolt. Angled groove 180 includes an angled surface 182 extending from bottom surface 52 of the bolt to surface 178. Hook 166 includes an angled surface 184 which extends from forward end 186 to an edge 188, and a second angled surface 190 which extends from edge 188 to hook top edge 192. Surface 184 is angled with respect to surface 190 as can be seen in FIG. 8.

When hook 166 is engaged in groove 180 as shown in FIG. 8, surface 184 extends beneath bottom surface 52 of the bolt and surface 176 engages surface 178 to lock the bolt in the FIG. 8 recoil location. When pump arm 42 is moved rearwardly in a cocking operation, front edge 192 of the operating arm engages surface 184, and pulls hook 166 out of groove 180 in direction 194 against the bias of spring 168. This frees bolt 42 from the hook. While the bolt is being freed from the hook, the pawl 114 is engaging operating arm 42 as above described whereby the forward movement of operating arm (opposite to recoil direction 60) moves bolt 42 back to the FIG. 2 battery location.

Figure 9:
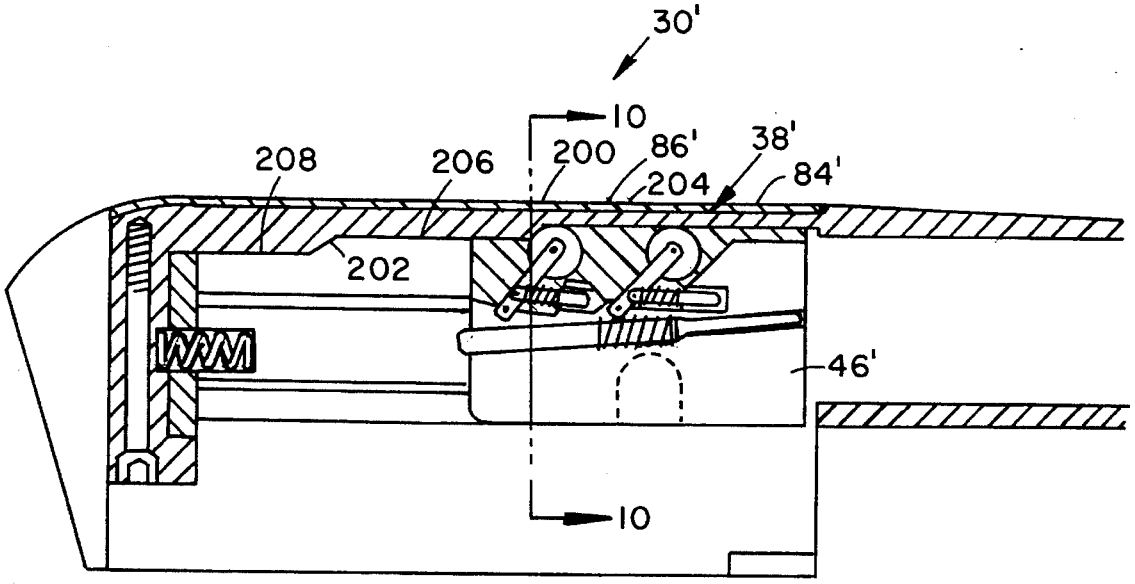
FIG. 9 is partially cutaway side elevational view of a shotgun having a plurality of spring-controlled rollers mounted on a breech bolt body and engaging ramps and lands located on a barrel hood located adjacent to a receiver housing.
Figure 10:
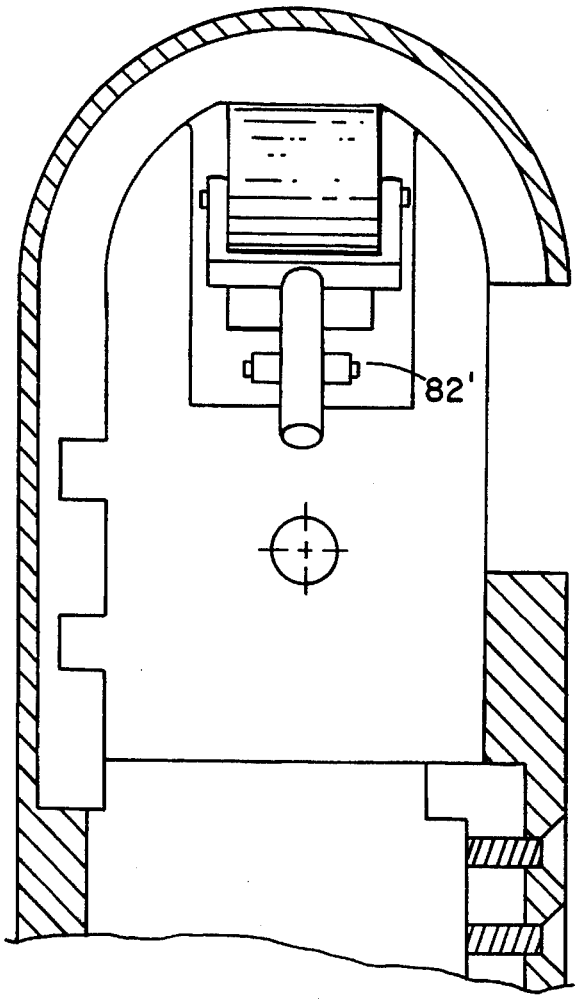
FIG. 10 is an elevational view taken along line 10–10 of FIG. 9.

While the rollers are shown in FIG. 2 as being mounted on the hood and engaging surfaces on the bolt, it is also contemplated that the rollers can be mounted on the bolt and engage surfaces on the hood. This alternative is shown in FIGS. 9 and 10. Thus, as shown, shotgun 30' includes a bolt 46' having a groove 82' defined therein and on which rollers 84' and 86' are mounted. Only two rollers are used in this form of the invention due to constraints associated with the length of the bolt. Rollers 84' and 86' are identical to rollers 84 and 86 described above, and thus will not be further described. Furthermore, operation of the bolt 46' is similar to that of bolt 46 described above, and thus will not be further described. Shotgun 30' includes a barrel hood 38' which has ramps 200 and 202 which connect lands 204, 206 and 208, and which are engaged by the rollers 84' and 86'.

Roller 86' engages ramp 200 to hold the bolt in the battery location covering the chamber. After the weapon is fired, bolt 46' moves in a recoil path. As bolt 46' moves in a recoil movement from the battery location shown in FIG. 9 to a recoil location shown for bolt 46 in FIG. 8, the mechanism associated with roller 86' tilts and pivots to permit roller 86' to move over ramp 200. When roller 86' moves off of ramp 200 onto land 206, roller 86' no longer exerts significant influence on the recoil motion of the bolt. Upon further recoil movement of the bolt, roller 84' engages ramp 200, and roller 86' engages ramp 202. Upon such engagements, both of the mechanisms associated with these rollers influence further recoil movement of bolt 46'. As was discussed above, the mechanisms can be designed to influence the recoil movement of bolt 46' equally, or with roller 86' being more influential in such movement than roller 84' or vice versa. As discussed above, shotgun 30' includes appropriate one-way locks to permit bolt 46' to move in a recoil movement, but will lock that bolt to the operating arms of the shotgun so the gun can be operated in the manner of a pump to load a new cartridge and return the bolt to battery.

Figure 11:
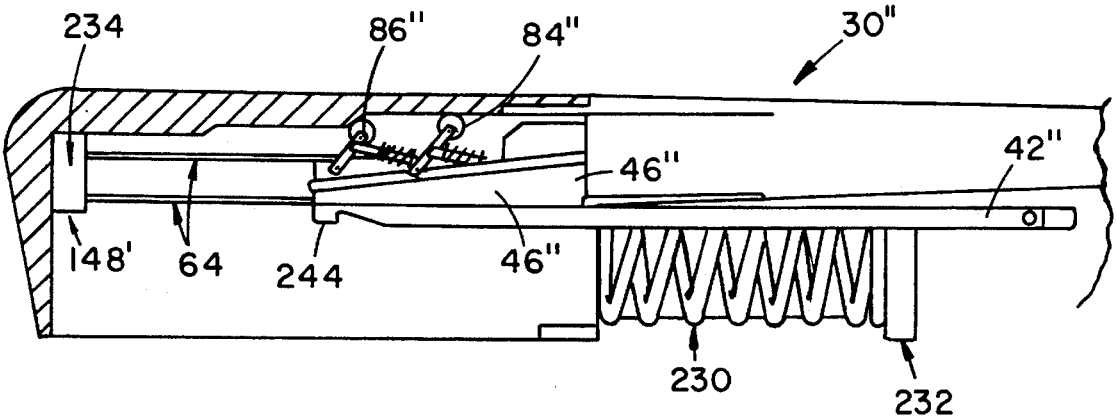
FIG. 11 is a partially cutaway view showing a shotgun having a steel receiver and a plurality of rollers mounted on a breech bolt thereof to control and influence recoil movement of that breech bolt.
Figure 12:
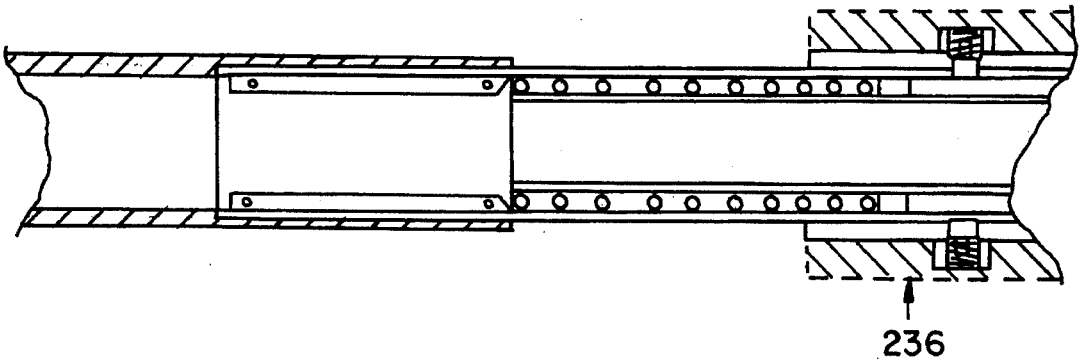
FIG. 12 is a bottom plan view of the FIG. 11 shotgun.
Figure 13:
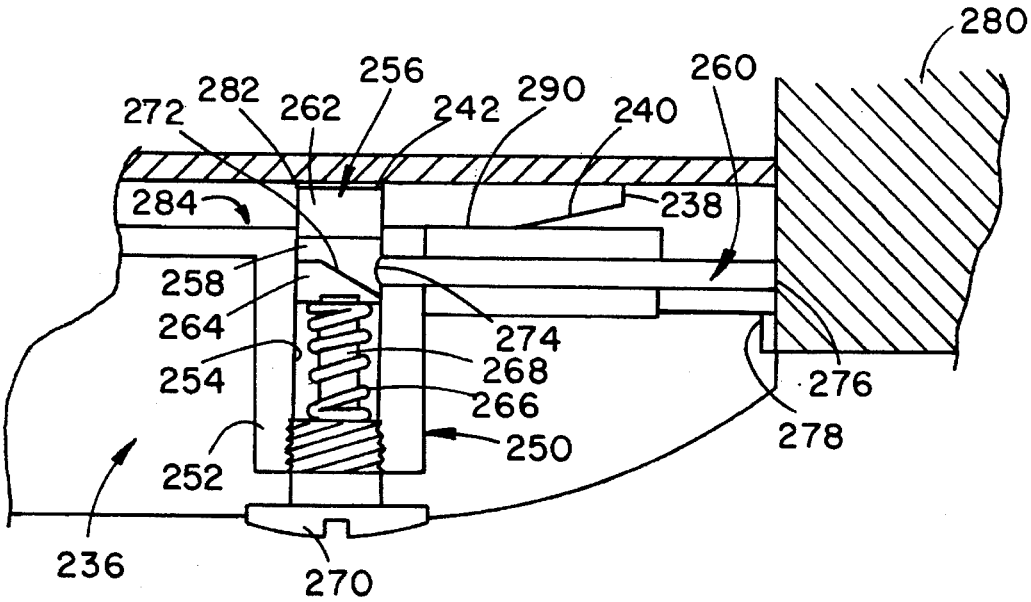
FIG. 13 is a detail view of detail 13 indicated in FIG. 12.

The above descriptions concern a shotgun having a receiver made of lightweight materials, such as aluminum. However, the present invention can also be used in conjunction with shotguns having receivers made of strong materials, such as steel. In the case of a steel receiver, a hood such as described above is not required, and the ramps, lands and spring systems can be located directly on the receiver. A shotgun 30" is shown in FIGS. 11–13, and attention is now directed to those figures. Shotgun 30" includes a primary recoil spring 230 attached to the magazine tube associated with shotgun 30" and connected at one end thereof to a spring retainer 232 attached to the operating arm 42" and has the other end bearing against the steel receiver. Recoil of bolt 46" is initially resisted by primary recoil spring 230, but is finally controlled and influenced by rollers as discussed above which are shown in FIG. 11 as being mounted on the bolt, but which can also be mounted on the receiver as discussed above in conjunction with FIG. 2. Shotgun 30" also includes bolt guiding rods 64 which engage corresponding grooves in the bolt as above discussed, with the exception being that rods 64 are mounted directly on the receiver. Shotgun 30" also includes a terminal pad mechanism 148' that differs from terminal pad mechanism 148 described above by omitting spring 158 as well as catch mechanism 160. However, mechanism 148' does include a neoprene buffer pad 234. Shotgun 30" includes yet another means for moving the bolt from the recoil position back to the battery position in a pump operation while permitting the bolt to move in a recoil motion. The means shown for shotgun 30" can be used with the above-described shotguns as well, and the primary spring can be included in the other shotguns as well if suitable.

Referring to FIGS. 11, 12 and 13, the means for cocking the weapon using a pump is shown as including an operating arm (while there are two operating arms, only one will be described as both are identical), such as arm 42" that is moved by a forearm 236 to cock the weapon. Operating arm 42" includes a forward end 238 having a ramp 240 thereon and a groove 242 defined therein near the ramp 240. Operating rod 42" also includes a rear end 244 having a bolt retaining notch 246 defined therein to engage a corresponding surface on bolt 46" to return the bolt to the battery location when the operating rod is moved forward during a cocking procedure. The operating arms remain attached to the bolt throughout the firing and cocking sequence. As shown in FIG. 13, shotgun 30" further includes an operating rod control mechanism 250 which includes a bore 252 defined in the forearm and having a tube 254 located in that bore. A plunger 256 includes a bore 258 defined therethrough through which a disconnect pin 260 is received. Plunger 256 includes a head 262 that is located to move into and out of groove 242 in operating arm 42", and lower head section 264 that is engaged by a spring 266 surrounding a spring mount 268 fixed to the head section 264. Spring force on the plunger is adjusted by a screw 270 mounted on forearm 236. Adjusting screw 270 also adjusts the position of plunger 256 relative to groove 242. Plunger 256 further includes a slanted surface 272 which is located to be engaged by forward end 274 of disconnect pin 260 when rear end 276 of that pin engages surface 278 of front barrel lug 280 that is fixed to the barrel of shotgun 30". Slanted surface 240 is located to engage surface 282 on section 262 and drive plunger 256 downwardly in direction 284 against the bias of spring 266 when surface 240 moves past plunger 256 as the operating rod is moved in a cocking procedure. With plunger 256 in the locking position shown in FIG. 13, operating rod 42" is connected with forearm 236 and will move therewith. However, when plunger 256 is in the unlocking position shown in dotted lines in FIG. 13, forearm 236 and operating rod 42" are disconnected, and the operating rod is free to move with the bolt 46" in a recoil direction. When the bolt reaches its recoil location, the forearm can be operated in a pump motion, wherein disconnect pin 260 will be moved to the FIG. 13 position due to the spring force exerted on surface 272 thereby moving plunger head 262 into the full line position shown in FIG. 13. However, as the forearm is moved rearwardly of the shotgun, surface 282, which can be slanted if desired, contacts surface 240 of the operating rod, and drives the plunger 256 downwardly in direction 284 and out of the way. As the forearm is moved further rearwardly, plunger 256 rides over surface 290 of operating rod 42", and finally becomes aligned with groove 242, at which time the plunger moves into the groove to lock the operating rod to the forearm. The forearm is then moved forward to move the bolt back from the recoil location to the battery location under control of the operating rods and the forearm. As soon as the forearm reaches the forward most location, disconnect pin 260 engages surface 278, and drives the plunger downwardly in direction 284 to disconnect the operating rod from the forearm whereby the firing cycle can be initiated with the block 46" under the control and influence of the spring system discussed above.

When the forearm is moved forward, a new cartridge is loaded while the bolt is moved back into the battery location. When the shotgun is fired, the bolt recoils under the control and influence of the primary spring 230 as well as the two spring-controlled rollers 84" and 86" as discussed above. The bolt can contact the buffer pad 234, and will be held there by a bolt lock mechanism in the trigger housing (not shown, but can be similar to such mechanisms as are used in autoloader shotguns). The bolt can be released from the operating arm by lifters (not shown, but can be similar to such lifters as are used in autoloading shotguns) in the shotgun.

Figure 14:
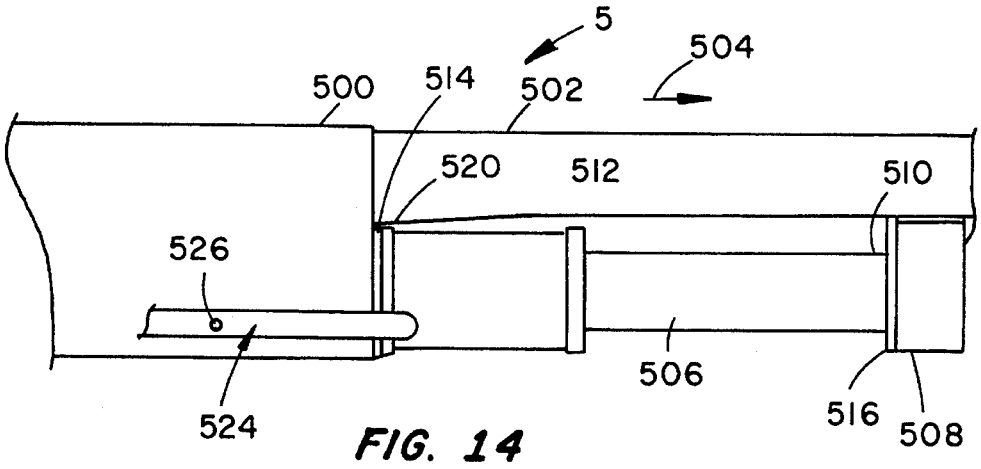
FIG. 14 shows a side elevational view of a portion of a pump shotgun which includes another form of the recoil absorption system of the present invention.
Figure 15:
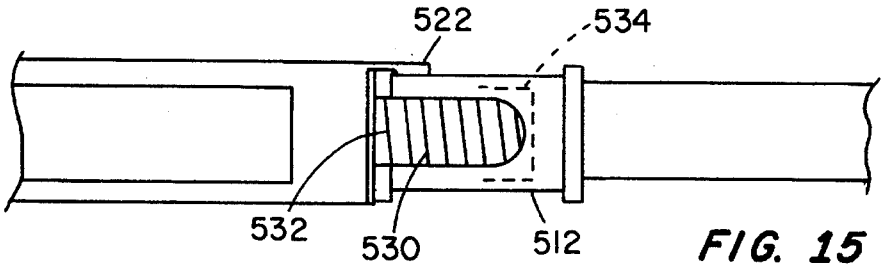
FIG. 15 shows a bottom plan view of the FIG. 14 pump shotgun, with a portion of a weight element cut away.

Shown in FIG. 14 is a portion of a pump-type shotgun S in which the breech block remains stationary during and after the firing of the weapon. Shotgun S includes a receiver 500 which is mounted on a stock (not shown) and has a barrel 502 mounted thereon to extend forwardly thereof. For the sake of convenience, the forward direction will be taken as shown by arrow 504 in FIG. 14, which is the direction of travel of a shot after the weapon is fired. A magazine tube 506 is mounted at its rear end on receiver 500 and is attached to the barrel by a lug 508 near the forward end 510 of the magazine tube.

A weight element 512 is hollow and cylindrical and is slidably mounted on the magazine tube. The weight slides between a rest location shown in FIG. 14 adjacent to the receiver, and a recoil location adjacent to lug 508 in response to firing of shotgun S. A washer, such as a DELRIN™ washer 514, is mounted on the magazine tube to be interposed between weight 512 and the receiver, while a second washer 516 is also mounted on the magazine tube to also be interposed between weight 512 and lug 508. The weight contacts the washers in its end locations.

Weight 512 includes a flange 520 that is engaged by hook 522 located on a forward end of a lever-like lock element 524. Lock element 524 is pivotally mounted on receiver 500 by pivot pin 526 located near the center of the lock element. The lock element and its operation will be discussed in greater detail below.

A progressive rate compression spring 530 surrounds the magazine tube and has one end 532 abutting washer 514 and a second end abutting a spring seat 534 fixed to weight 512. Spring 530 biases weight 512 toward washer 516.

Figure 16:
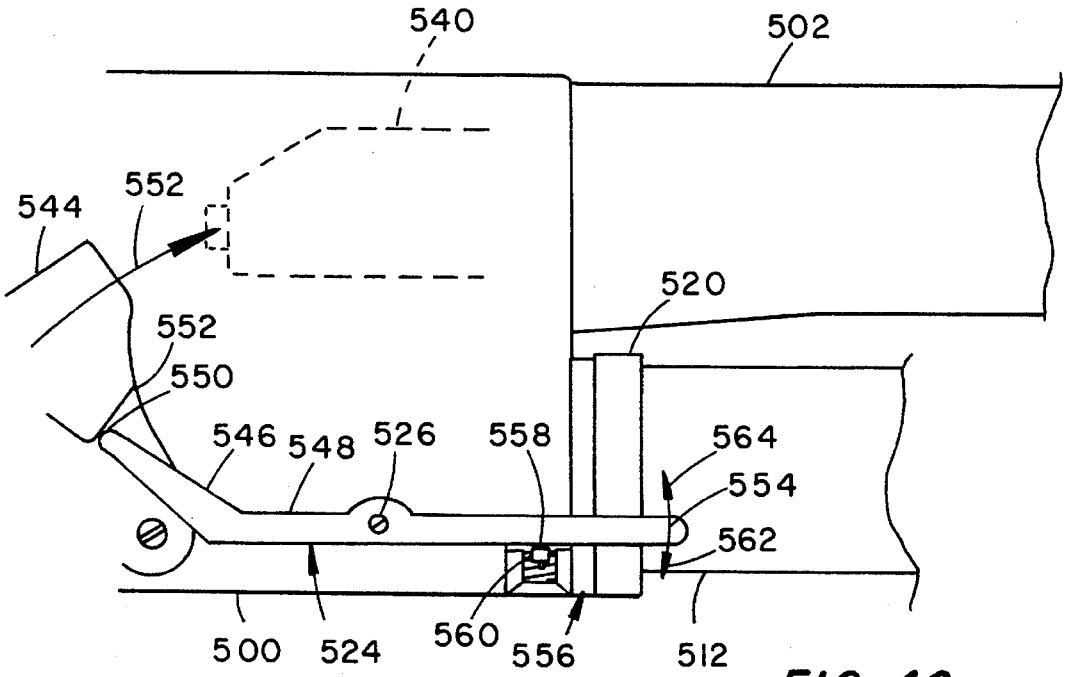
FIG. 16 shows a partially cutaway side elevational view of a receiver section of the pump action shotgun shown in FIGS. 14 and 15.

As is best shown in FIG. 16, shotgun S includes a breech block 540 having a firing pin 542 that is located in receiver 500 and is operated in the manner common to pump shotguns. The shotgun is fired by a hammer 544 operating in the manner common to pump shotguns to strike firing pin 542. Lock element 524 includes a rear end 546 that is angled upwardly from body 548 and includes a rounded end edge 550. An angled ramp 552 is defined in hammer 544 to strike edge 550 as the hammer moves from the cocked position shown in FIG. 16 to a firing pin striking position as indicated by arrow 552. Lock 524 is pivoted to move hook 522 in directions 554 shown by the double-headed arrow in FIG. 16 in the manner of a first degree lever. A spring 556 is based on receiver 500 and has a ball 558 attached to the other end thereof and is guided by an appropriate spring guide 560 to engage the lock arm and bias that arm downwardly as indicated by head 562 of the double-headed arrow. Upon end 550 engaging ramp 552, the lock arm is moved upwardly as indicated by head 564 of the double-headed arrow.

When hook 522 moves in direction 564, it is moved out of locking engagement with flange 520 thereby releasing the weight. Once released, the weight moves under the influence of spring 530 from the rest location towards the recoil location at the other end of the magazine tube. Weight 512 is moved back to the rest location from the recoil location by moving the forearm (not shown) during the cocking procedure. Weight 512 is releasably attached to the forearm by a one-way catch such as described above for releasably locking the breech block to the bolt operating rails in the above-described forms of the invention in which the breech block is permitted to move.

The characteristics of spring 530, the mass of weight 512, the size, angle and location of ramp 552 are all selected so that weight 512 contacts washer 516 at or near the time pressure in the barrel reaches its maximum as the shot moves down the barrel after firing.

The contact between weight 512 and washer 516 creates an impact force on shotgun S that is directed forwardly of that shotgun. The recoil force associated with the firing of the weapon creates a force directed rearwardly of the weapon. Thus, the recoil force is countered by the force associated with the impact between weight 512 and washer 516. This impact force is sized to nearly equal the recoil force whereby the user feels little if any force on his or her body due to the counteraction of forces.

It is understood that while certain forms of the present invention have been illustrated and described herein, it is not to be limited to the specific forms or arrangements of parts described and shown.

We claim:

1. A pump-type shotgun comprising:

A) a breech block which moves between a battery position adjacent to a firing chamber of a pump-type shotgun and a recoil position spaced from said battery position, said breech block being free to move in a recoil movement from said battery position toward said recoil position, said recoil movement being caused by gases generated in the firing chamber after a round of ammunition has been fired;

B) manual cocking means for manually moving said breech block in a return movement to said battery position;

C) locking means for releasably locking said breech block to said manual cocking means;

D) spring means for spring loading said breech block in said battery position and controlling the recoil movement of said breech block;

E) unlocking means for releasing said breech block from said manual cocking means for firing the round of ammunition with said breech block being held by said spring means in said battery position when the round of ammunition is fired; and F) means for disconnecting said spring means from said breech block after said breech block has moved out of said battery position during said recoil movement with said breech block continuing in said recoil movement toward said recoil position in a manner which is unrestrained by said spring means after being disconnected from said spring means.

2. The pump-type shotgun defined in claim 1 wherein said spring means is mounted on an element located adjacent to said breech block.

3. The pump-type shotgun defined in claim 2 further including a ramp on an element located adjacent to said breech block.

4. The pump-type shotgun defined in claim 1 further including breech block guiding means for guiding said breech block during a recoil movement.

5. The pump-type shotgun defined in claim 4 wherein said breech block guiding means includes a rail located beneath said breech block.

6. The pump-type shotgun defined in claim 5 wherein said breech block guiding means further includes a groove defined in an element located adjacent to said breech block and a rail on said breech block slidably received in said groove.

7. The pump-type shotgun defined in claim 1 further including one-way locking means for releasably locking said breech block to an operating arm.

8. The pump-type shotgun defined in claim 7 wherein said one-way locking means includes a pawl pivotally mounted on said breech block, a rod slidably mounted on said breech block to pivotally move said pawl when said breech block is in a predetermined location, and a groove in the operating arm which receives said pawl.

9. The pump-type shotgun defined in claim 1 further including a terminal buffer means for abutting said breech block when said breech block is in a recoil location.

10. The pump-type shotgun defined in claim 9 wherein said terminal buffer means further includes a block locking means for releasably locking said breech block in the recoil location.

11. The pump-type shotgun defined in claim 10 wherein said block locking means includes a hook pivotally mounted on the terminal buffer means, and which includes means biasing said hook into a breech block engaging position.

12. The pump-type shotgun defined in claim 11 wherein said hook includes a surface that is engaged by the operating arm to disengage said hook from said breech block.

13. The pump-type shotgun defined in claim 9 wherein said terminal buffer means further includes a buffer pad.

14. The pump-type shotgun defined in claim 1 wherein said cocking means includes a plunger slidably mounted in a forearm, a spring biasing said plunger toward an operating arm, a groove in the operating arm into which said plunger is received to connect the operating arm to the forearm, and disconnecting means for disconnecting said plunger from the operating arm.

15. The pump-type shotgun defined in claim 14 wherein said disconnecting means includes a ramp in said plunger, a disconnect pin on the forearm and located to engage said ramp when the forearm is in a predetermined location, and means for forcing said disconnect pin against said ramp.

16. The pump-type shotgun defined in claim 15 wherein said disconnecting means further includes a ramp on the operating arm and a surface on said plunger that engages the ramp on said operating arm when the operating arm and the forearm are in a preset location.

17. The pump-type shotgun defined in claim 14 further including a primary spring connected to said breech block.

18. The pump-type shotgun defined in claim 1 further including a steel receiver in which said breech block is located.

19. The pump-type shotgun defined in claim 1 wherein said unlocking means includes timing means for releasing said breech block at a preselected time.

20. A method of absorbing recoil associated with firing of a pump-type shotgun comprising steps of:

A) moving a breech block between a battery position adjacent to a firing chamber of a pump-type shotgun and a recoil position spaced from the battery position in a recoil movement which is caused by gases generated in the firing chamber after a round of ammunition has been fired;

B) manually moving the breech block in a return movement to the battery position;

C) freeing the breech block from manual control when the breech block is in the battery position for firing the round of ammunition;

D) applying spring means to the breech block and holding by the spring means the breech block in the battery position for firing the round of ammunition;

E) releasing the breech block from the spring means after the breech block has moved out of the battery position during the recoil movement and permitting the breech block to continue said recoil movement unrestrained by the spring means.

* * * * *